United States Patent [19]

Bruhnke et al.

[11] Patent Number: 4,896,520

[45] Date of Patent: Jan. 30, 1990

[54] LOCKABLE GLOVE COMPARTMENT COVER ARRANGEMENT FOR VEHICLES

[75] Inventors: Ulrich Bruhnke, Ehningen; Helmut Fischer; Matthias Schwarz, both of Böblingen; Erwin Uecker, Ratingen; Reinhard Wittwer, Heiligenhaus, all of Fed. Rep. of Germany

[73] Assignee: Daimler-Benz AG, Stuttgart, Fed. Rep. of Germany

[21] Appl. No.: 237,383

[22] Filed: Aug. 29, 1988

[30] Foreign Application Priority Data

Aug. 29, 1987 [DE] Fed. Rep. of Germany ..... 3728960

[51] Int. Cl.[4] ..... B65D 55/14

[52] U.S. Cl. ..... 70/159; 70/84; 70/256

[58] Field of Search ..... 70/158, 159, 256, 255, 70/257, 258, 237, 84

[56] References Cited

U.S. PATENT DOCUMENTS

| | | | |
|---|---|---|---|
| 1,590,006 | 6/1926 | Werley | 70/258 |
| 2,313,711 | 3/1943 | Jacob | 70/84 |
| 3,016,968 | 1/1962 | Lenz | 70/256 |
| 3,581,532 | 6/1971 | Anderson | 70/84 |
| 4,073,170 | 2/1978 | Mijabayashi | 70/256 |

FOREIGN PATENT DOCUMENTS

| | | |
|---|---|---|
| 866617 | 2/1956 | Fed. Rep. of Germany . |
| 3301442 | 7/1984 | Fed. Rep. of Germany . |
| 3230865 | 5/1985 | Fed. Rep. of Germany . |
| 3207718 | 8/1985 | Fed. Rep. of Germany . |

*Primary Examiner*—Robert L. Wolfe

*Attorney, Agent, or Firm*—Barnes & Thornburg

[57] ABSTRACT

The invention relates to a lockable glove and auxiliary compartment cover system for motor cars having a lock which is transferable into its tripping position by the stressing of a tripping lever by means of an actuating element. A closing member is provided which can be rotated between positions permitting and blocking the operative connection between the actuating element and the lock to change the security condition of the system. The change of the security condition occurs by means of a toothed-wheel gear which comprises a spur gear element rotatable with the closing element and a further gear element meshing with the spur gear element. In order to permit a handier arrangement of the actuating elements, the further gear element is likewise constructed as a rotatably mounted spur gear element, at least one of the spur gear elements, which belongs to a push-button, is guided for axial sliding, and a tripping stud protrudes eccentrically from the spur gear elements guided for axial sliding by means of which the tripping lever is pivotable in order to trip the lock.

22 Claims, 3 Drawing Sheets

LOCKABLE GLOVE COMPARTMENT COVER ARRANGEMENT FOR VEHICLES

BACKGROUND AND SUMMARY OF THE INVENTION

The invention relates to a lockable glove compartment cover for motor vehicles of the type having a passenger compartment with at least one storage compartment in a vehicle dashboard or the like which is designed to be locked and unlocked.

Such a lockable glove compartment cover for motor vehicles is disclosed in German Patent No. (DE-PS) 3,230,865, wherein a handle flap as actuating element is integrated eccentrically on the side facing the driver in the glove compartment cover of the glove compartment which is arranged on the passenger side. This handle flap is mounted pivotably on a rotary rod which faces a central lock arranged centrally on the glove compartment cover and projects sufficiently for its projecting end to serve as a guide rod for a sliding sleeve with a rack profile. The rack profile is engaged by a pinion segment connected integrally in terms of rotation to a closing cylinder arranged beside the handle plate, whereby the sliding sleeve is slidable axially on the guide rod in the course of the rotation of the closing cylinder core. Depending upon the axial position of the sliding sleeve, the lock is tripped by means of a lever integral with the guide rod or else the pivotal movement of the lever is idle.

However, the construction of this known closing mechanism of a glove compartment cover presupposes that the closing cylinder is arranged beside the handle flap on the side facing the lock, which inevitably results in different operating distances for the driver from the handle flap and from the closing cylinder.

An underlying object of the invention is to develop further the closing mechanism of a lockable glove compartment cover so that the closing member can be arranged both beside and also above or beneath an actuating element.

According to the invention, this object is achieved by using an axially movable spur gear in the drive train for the cover latch, which spur gear can be rotated between operative and inoperative positions by a gear wheel on the locking cylinder. In this case the distance between the actuating element and the closing member is determined by the diameter of the corresponding spur gears, whilst any relative arrangement of the associated actuating element on a circle about the closing member is conceivable.

Because a compact push-button is provided as actuating element, the actuating element and the closing member as a whole can be arranged with great space economy.

As in the prior art, the closing member can be formed by a closing cylinder or by a servomotor, with the latter of which a spur gear element must likewise be coupled in rotation.

The use of a linear servo drive as servomotor is used in embodiments having a central locking system, additionally present which also operates on the basis of such servo drives. This creates the advantageous possibility of integrating the servomotor associated with the glove compartment cover into the system of the central locking installation.

A plurality of spur gear elements which belong to different push-buttons can be driven simultaneously by the closing member or locking cylinder. This results in a structural simplification of the closing mechanism when a divided glove compartment cover is provided with a plurality of locks to lock different covers at different storage compartments. By this means each compartment cover can be opened separately from the other. But the advantage of simplification also applies if a further storage container provided with a lockable cover is arranged in the instrument panel of the motor vehicle in addition to the glove compartment. Only one closing member or locking cylinder is required for a plurality of actuating elements in both cases.

In preferred embodiments the closing member is combined with the push-buttons to form a block-like subassembly which can be assembled with a small time outlay.

It is also advantageous for a convenient arrangement of the operating elements if the lock in each case is connected to the associated tripping lever by means of a cable train. In this case the operating elements may also be integrated into the instrument panel of the motor care remotely from the glove compartment, staggered laterally towards the driver's seat, for example, whereby they are more handily placed.

Each spur gear element on the push-button side may also be rotatable into its secured position both manually by means of a closing cylinder and by servo actuation by means of the servomotor.

For this purpose, however, a freewheel which permits a rotary movement of the spur gear elements when the closing cylinder is locked must be present in the rotary transmission chain between the closing cylinder and the servomotor.

Other objects, advantages and novel features of the present invention will become apparent from the following detailed description of the invention when considered in conjunction with the accompanying drawings.

DETAILED DESCRIPTION OF THE DRAWINGS

Figure 1:
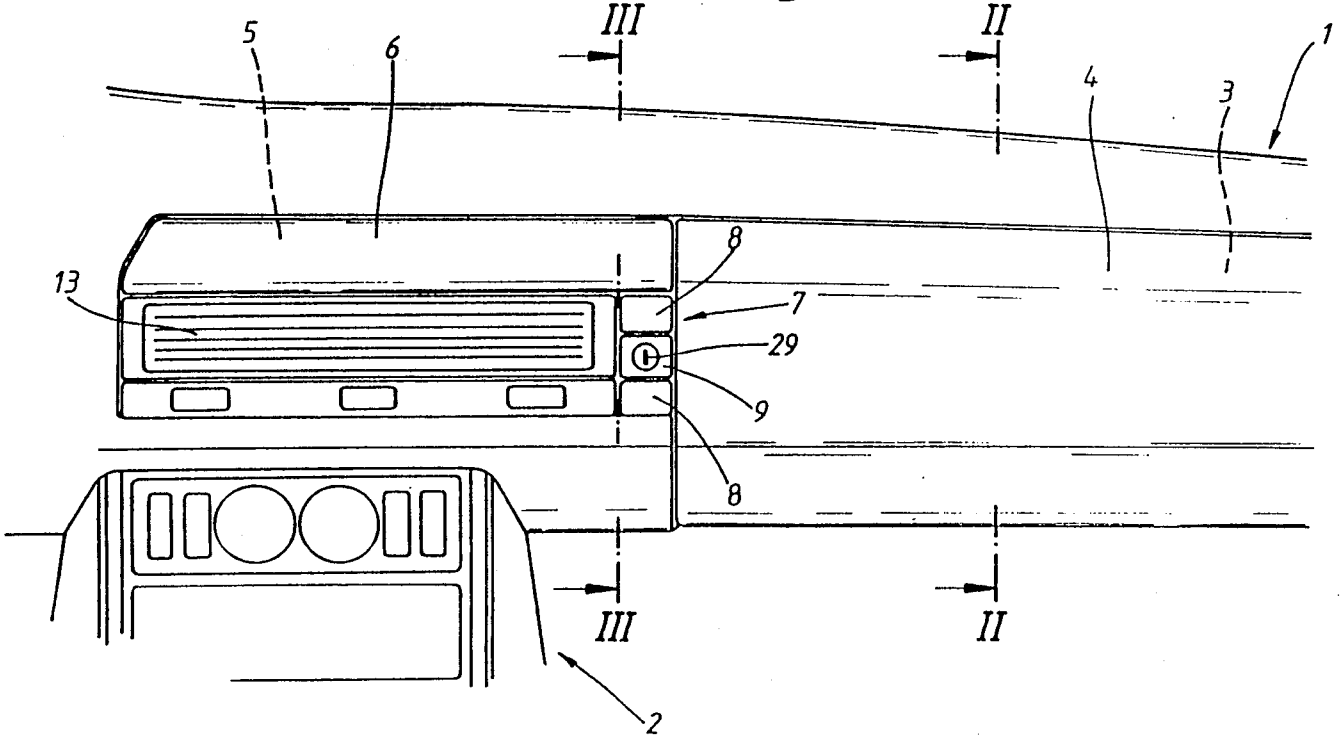
FIG. 1 shows a diagrammatic elevation of the region of an instrument panel with two lockable storage compartments, constructed in accordance with a preferred embodiment of the invention.

As FIG. 1 shows, a glove compartment 3, which is present in an instrument panel 1 on the right-hand side beside a central console 2, is covered towards the interior of the motor car by means of a glove compartment cover 4. A further storage shelf 5 of narrower construction, which is provided to accommodate a travel calculator, spectacles, etc., is present on the left-hand side beside the glove compartment 3 aligned with the top edge of the glove compartment cover 4. This storage shelf 5 is also closed by means of a cover 6. Immediately beside the left-hand edge of the glove compartment cover 4, an operating block 7 for both covers 4 and 6 is inserted into the instrument panel 1, and fastened to the latter, beneath the cover 6. The operating block 7 comprises three operating elements arranged one under the other in the form of rectangular functional elements. The top and the bottom functional elements each consist of a push-button 8, whereas the central functional element is constructed as a key operated locking or closing cylinder 9. The cooperation of this closing cylinder 9 with the two push-buttons 8 is explained more fully below.

Figure 2:
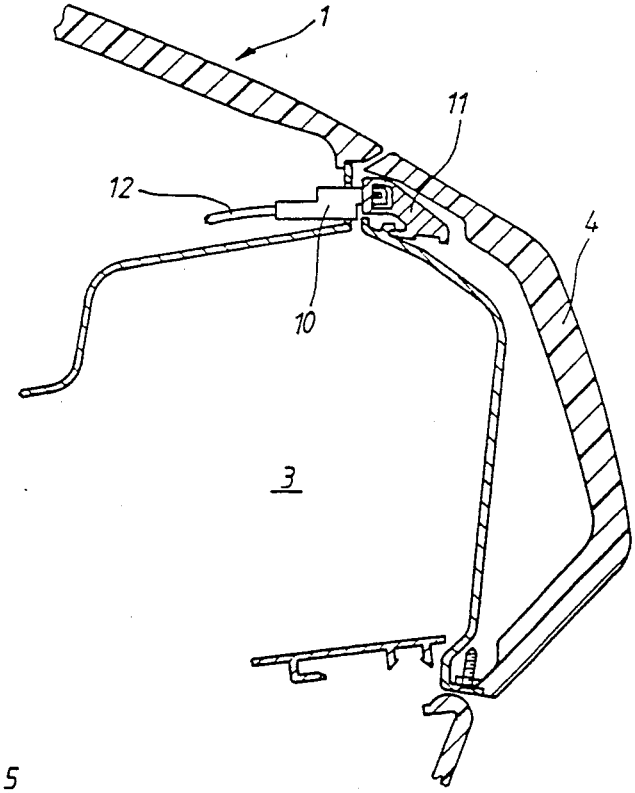
FIG. 2 is a vertical sectional view taken along the line II—II in FIG. 1.

The glove compartment cover 4 is mounted pivotably about a horizontal axis which extends in the lower edge region of the cover 4 in a manner not shown. Cover 4 is retained in its closed position, as can be seen in connection with FIG. 2, by a hook lock 10 fastened to the instrument panel, which engages behind a closing bolt part 11 fastened in the center of the glove compartment cover 4. The center line of gravity of the glove compartment cover 4 extends set backwards sufficiently relative to its stop axis for it to hinge open automatically into its open position by its deadweight after the hook lock 10 is tripped. The tripping movement is transmitted from the lower push-button 8 by means of a Bowden cable 12 (FIGS. 2 and 4), which extends inside the instrument panel 1. After the release of the push-button 8 the hook lock 10 snaps back into its closed position due to a spring loading. The glove compartment cover 4 can therefore be closed again by simply pushing it shut.

Figure 3:
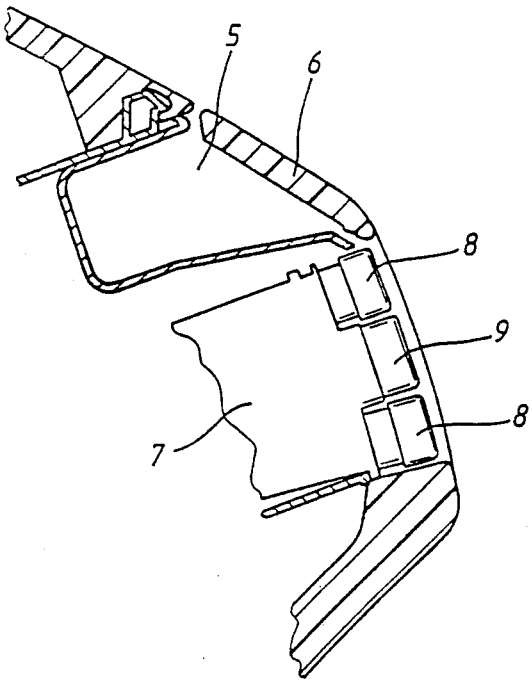
FIG. 3 is a vertical sectional view taken along the line III—III in FIG. 1.

As is clear from reference to FIG. 3, the gravity of the cover 6 cannot be used to hinge it open, because it is located in a plane of extent coincident with the top edge section of the glove compartment cover 4. In addition, a cover 6 hinged open downwards would also obstruct the exit of fresh air from fresh air nozzles 13 located beneath the storage shelf 5, and also access to the operating block 7.

The cover 6 is therefore pivotable away upwards by being mounted on laterally attached guide members which guide the cover 6 parallelogram-fashion. The guide members of the cover 6 are subject to spring loading in its opening direction, so that after an associated lock is tripped an opening feed is induced in the cover 6 automatically by the spring power and drives it into its top limit position. Subsequently pushing the cover 6 to shut the same pretensions the lifting spring again and it is retained in this accumulator position by the cover lock.

The tripping movement of the lock associated with the cover 6 is also transmitted by a Bowden cable 12 from a push-button 8, whilst the upper push-button 8 must be activated for this purpose. The lock arrangement for cover 6 is similar to that for cover 4 described above.

Figure 4:
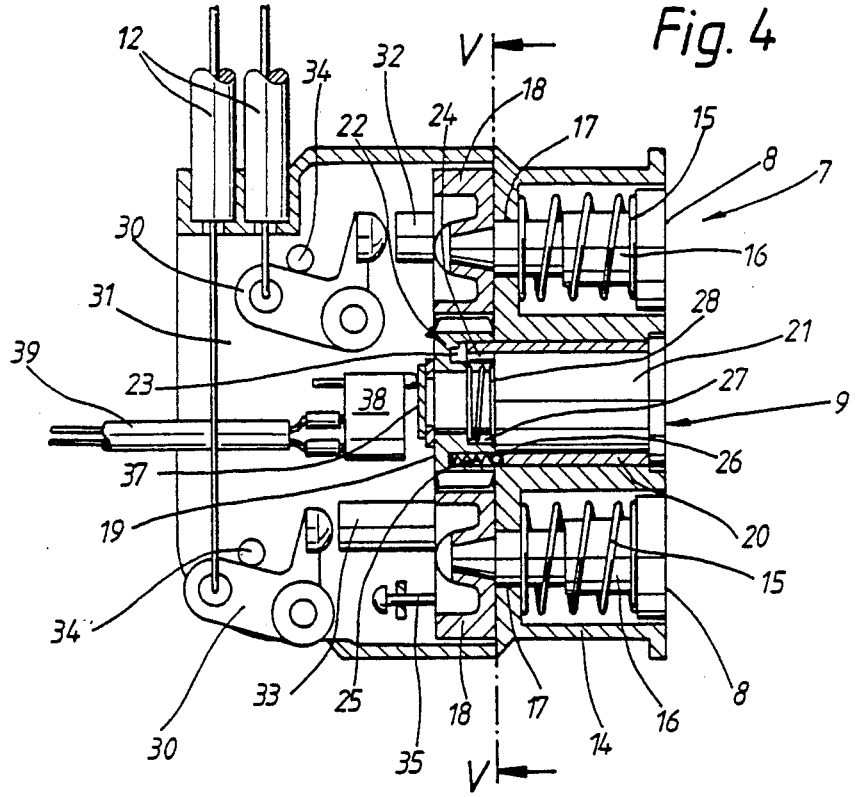
FIG. 4 is a vertical sectional view through an operating element block for actuating the cover of the storage compartments.

Whether a cable line actuation can occur at all with the push-buttons 8 is a function of the security condition of the push-buttons 8, as explained below with reference to FIG. 4.

The operating block 7 comprises a generally rectangular housing 14 which is provided, starting from the narrow side facing the interior of the motor car, with three superposed shaft openings, of which the central shaft opening exhibits a circular cross-section and each of the two outer shaft openings have identical rectangular cross-sections. In each of the upper and lower shaft openings a push-button 8 adapted to the shaft cross-section is guided slidingly in the downward or inward direction and is retained in the illustrated initial position by a return spring 15 constructed as a helical compression spring. The sliding guidance is provided by a telescopically constructed push-button foot 16, which permits the push-buttons 8 to be pressed in for a feed distance of approximately 8 mm. An internal telescope of the push-button foot 16 penetrates with an accurate fit a bore 17 in the base of the housing 14, which delimits the associated shaft opening, and projects out of the base on the side remote from the shaft. A spur gear element 18 is mounted rotatably and secured against axial sliding on the protruding longitudinal sections of the inner telescope of each of the respective two push-buttons 8. The spur gear elements 18 therefore participate in the axial feed of the push-buttons 8 when the latter are pressed in. The spur gear elements 18 exhibit the same diameter and are provided with a Plain tooth system of the same pitch on half their circumferential surface. A third spur gear element 19, while provided with a plain tooth system all round, which is arranged between the spur gear elements 18, meshes with the latter. The spur gear element 19 is coupled in rotation with the closing cylinder 9, the closing cylinder housing 20 of which is fastened sunk in the central shaft of the housing 14. For this purpose the cylinder core 21, which is mounted rotatably in the closing housing 20, communicates through a freewheel or lost play connection 22 with the spur gear element 19, and the freewheel 22 permits a relative rotation of approximately 90 degrees between the spur gear element 19 and the cylinder core 21. The freewheel 22 consists of a partial annular groove 23 which is recessed out of the end face of the spur gear element 19 facing the cylinder housing 20, and of a driver finger 24 connected firmly to the cylinder core 21 and engaging into said groove 23.

In order to permit the cylinder core 21 to be arrested relative to the spur gear element 19 in the limit positions of the freewheel 22, the spur gear element 19 is provided with a spring-loaded ball catch device 25 which cooperates with corresponding catch depressions 26 integral with the cylinder housing. A rotary spring device 28 is present in circumferential annular groove 27 which is recessed out of the internal circumference of the spur gear element 19 along part of the length thereof. Spring device 28 is disposed so that the cylinder core 21 can be returned by the spring loading of this device 28 from both directions of rotation into a zero position which corresponds to a key withdrawal position in which a key insertion aperture 29 extends vertically. Starting from this key withdrawal position, a secured position of the push-buttons 8 is required to be reached by a partial rotation of the cylinder core 21 clockwise, and an unsecured position by a partial rotation counterclockwise. In the unsecured position corresponding to FIG. 4 an associated tripping lever 30 can be impact stressed by means of each of the push-buttons 8. For this purpose the two tripping levers 30, of identical construction, are mounted pivotably on a support plate 31 shaped integrally on the housing 14 at an interval behind the associated spur gear element 18. The tripping lever 30 is in each case a two-armed lever, the arms of which extend at a mutual angle of approximately 90 degrees, and which is mounted centrally in its apex region. A cable end of the Bowden cable 12 is hooked into a hooking eye at the end of an arm extending in the feed direction of the push-button 8. An end region of the second arm is bent at right angles out of the pivotal plane of the tripping lever 30 and therefore protrudes into the axial alignment of the spur gear element 18.

A tripping stud 32 or 33, which is connected rigidly to the associated spur gear element 18, protrudes eccentrically from the end face of the associated spur gear element 18 opposite the bent end region of the tripping lever 30. The two tripping studs 32 and 33 exhibit a circular cross-section and differ only in their length, which is coordinated with the arrangement of the tripping levers 30, so that the end face of the tripping studs 32 and 33 faces opposite the aligned end region of the associated tripping lever 30 at an interval of 1 to 2 mm when push buttons 8 are not depressed.

In order for the tripping levers 30 to be retained in their illustrated initial position, they are urged by a spring, not shown, against pivotal stops 34 which are arranged integrally with the support plate. When one or both push-buttons 8 is/are depressed, the depression feed is transmitted through the push-button foot 16 to the spur gear element 18. Because the depression feed is somewhat shorter than the meshing width of the spur gear element 18 with the spur gear element 19, the tooth engagement is then maintained. After a short idle stroke fraction, the end of the tripping stud 32 or 33 strikes the bent end region of the associated tripping lever 30 and pivots it counterclockwise by a corresponding angular amount, whilst the hook lock 10 or the lock, not shown, of the cover 6 is tripped through the associated Bowden cable 12, depending upon whether the lower or the upper push-button 8 was depressed.

A cylindrical journal 35, which extends parallel to the feed direction of the push-button 8, protrudes from the end face of the lower spur gear element 18 diametrically opposite the tripping stud 33. The free end of a piston rod of a bipressure element 36 is mounted pivotably and with transverse sliding mobility on the journal 35. The bipressure element 36 belongs to a central locking installation of the motor car and is transferable by control from a door operating point into a retracted or extended position alternately, the cylinder of the bipressure element 36 being stressable by a bipressure pump. The feed stroke of the bipressure element 36, which is braced in the instrument panel in a manner not shown, corresponds to one quarter revolution of the spur gear element 18. To prevent the depression of the spur gear element 8 being obstructed by the articulated bipressure element 36, the transverse sliding mobility of its piston rod is coordinated with the depression feed of the associated push-button 8.

In order to ensure that a change of the security position of the push-buttons 8 occurs through the central locking installation as a function of the existing security state, which of course can also be changed mechanically through the closing cylinder 9, a raised switch cam 37, which cooperates with a microswitch 38, is retained integrally in terms of rotation on the end face of the central spur gear element 19 remote from the locking cylinder. For this purpose the microswitch 38 is located opposite the switch cam 37 and senses the latter by means of a switch contact as a function of the rotary position of the closing cylinder core 21. The switching state of the microswitch 38 is detectable through an electric switch line 39 by the control logic of the central locking installation and is taken into consideration appropriately in the case of remote closing. It is therefore possible for a change of the security position of both the push-buttons 8 to be effected selectively manually or through the bipressure element 36. In the former case the push-buttons 8 can be transferred from their unsecured position according to FIG. 5 into their secured position according to FIG. 6 by means of the closing cylinder 9, the key being inserted, by rotating it starting from its vertical key withdrawal position through 90 degrees to the right. The cylinder core 21 is then rotated relative to the cylinder housing 20. Because, in the unsecured position, the driver finger 24 contacts terminally in the groove 23 of the freewheel 22, the spur gear element 19 is rotated conjointly clockwise without slip, therefore the two spur gear elements 18 also receive a rotary impulse of equal value in the opposite direction of rotation.

Due to this partial rotation of the spur gear elements 18, the tripping studs 32 and 33 are also conjointly moved, and in the secured position their end faces are disposed so that with axial movement of buttons 8 they will engage the pivot mount of the tripping levers 30. In the case of a push-button actuation, therefore, it is no longer possible for a pivotal impulse to be imparted to the tripping levers 30; on the contrary, the push-buttons 8 are blocked after an idle stroke of 1–2 mm in the feed direction, because the ends of the tripping studs 32, 33 strike against the pivot mount region of the tripping lever 30. The rotary position of the gear elements 18 is maintained after the key is released, because the ball catch device 25 has engaged into an associated catch depression 26. However, the cylinder core 21 is subject to spring loading by the rotary spring device 28, and therefore snaps back into its initial position, whilst the driver finger 24 snaps by freewheel into its opposite limit position in the groove 23.

Figure 5:
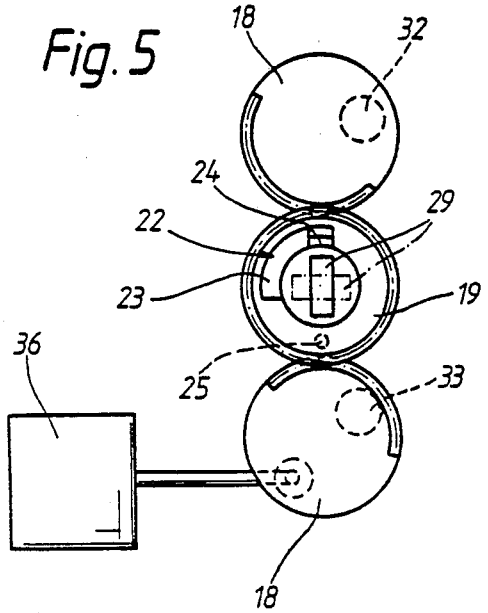
FIG. 5 is a diagrammatic elevation of the cooperating spur gear elements with servomotor drive in the secured position.
Figure 6:
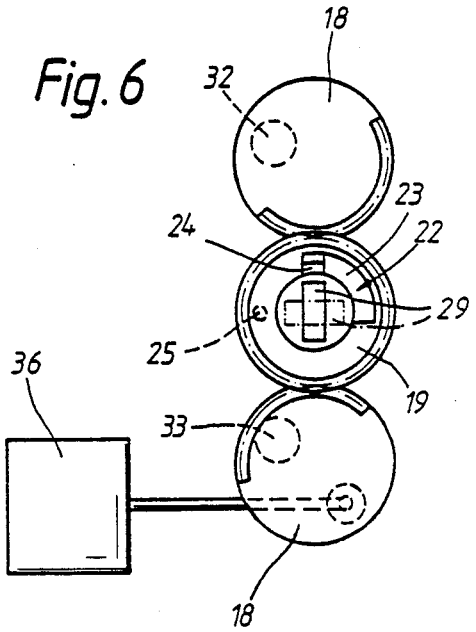
FIG. 6 shows the elevation according to FIG. 5 in the corresponding unsecured position.

Consequently it is again possible, upon a change from the secured position according to FIG. 6 into the unsecured position according to FIG. 5, by rotating the key out of the vertical key withdrawal position through 90 degrees to the left, for the spur gear element 19 to be entrained without slip. After the unsecured position is reached, the ball catch device 25 catches again into the second catch depression 26 staggered through 90 degrees, so that the spur gear element 19 is also anchored in this rotary position. After the key is released the cylinder core 21 rotates back automatically by its rotary spring loading into its key withdrawal position, so that a slip-free closing rotation is again possible by virtue of the freewheel 22.

When the security state of the push-buttons 8 is controlled through the central locking unit, the closing or opening rotation is transmitted from the bipressure element 36 to the associated spur gear element 18, and equivalent positions of the spur gear element 18 and 19 as in the case of the manual actuation explained occur due to the freewheel 20.

Since, irrespectively of the mode of operation, the spur gear elements 18 mesh with the spur gear element 19 only through a rotary angle of approximately 90 degrees, they can also be of circular segment shape in order to achieve a lighter construction with economy of materials.

Apart from the described combination between manual and servomotor change of the security state, embodiments are contemplated where the security state of the push-buttons 8 is designed with actuation purely by the closing cylinder or with actuation purely by the servomotor. In the case of actuation only by the closing cylinder it would then be possible to couple the cylinder core 21 to the spur element 19 integrally in terms of rotation without play. However, in this case it would be necessary to provide a further key withdrawal position interlocked by the closing cylinder, and corresponding to the secured position.

In the case of actuation only by the servomotor the closing cylinder 9 could be omitted completely and the spur gear elements 18 could optionally mesh mutually, the spur gear element 19 being omitted.

Alternative embodiments are also contemplated wherein in the embodiment illustrated in the drawing, an additional key withdrawal position interlocked by the closing cylinder is provided, which would therefore acquire the character of a safe security. In such a position the bipressure element 36 would be blocked in the direction of the opening feed. Such a key-secured position would be suitable for convertibles, which are frequently parked with an open roof.

All the contemplated embodiments present the advantage that a plurality of operating elements can be locked or unlocked simultaneously by one closing member, whereby an economy of closing members is possible.

Due to this advantageous functional coupling of a glove compartment cover locking system with the locking of further container covers, the subject of the invention may appropriately be called an interior central locking unit.

Although the present invention has been described and illustrated in detail, it is to be clearly understood that the same is by way of illustration and example only, and is not to be taken by way of limitation. The spirit and scope of the present invention are to be limited only by the terms of the appended claims.

We claim:

1. Lockable glove compartment cover arrangement for motor vehicles comprising:

a first compartment cover for covering a first storage compartment in a vehicle dashboard or the like, first latch means for latching the first cover in a closed position, first actuating element means for actuating the first latch means to an open position, and securing means for controlling the security condition of the first actuating element means between a secured position preventing actuation of the first latch means to an open position and an unsecured position permitting actuation of the first latch means to an open position, wherein said first actuating element means includes a first spur gear element operatively connected to a first push button to move axially therewith, said first spur gear element including an eccentrically offset first abutment stud which is operable in response to axial movement of the first push button to effect actuation of the first latch means to an open position when in an unsecured rotative position and which is inoperable to effect actuation of the first latch means to an open position when in a secured rotative position, and wherein the securing means includes a toothed wheel gear in meshing driving engagement with said first spur gear element to move the first spur gear element between its respective unsecured and secured positions in response to rotation of the toothed wheel gear.

2. Lockable glove compartment cover arrangement according to claim 1, wherein the securing means comprises a locking cylinder with a cylinder core rotatably fixed with the toothed wheel gear.

3. Lockable glove compartment cover arrangement according to claim 2, wherein the securing means comprises a servomotor operative to change the rotative position of the toothed wheel gear.

4. Lockable glove compartment cover arrangement according to claim 3, wherein the servomotor is constructed as a linear servo drive and wherein a linkage connection to the servo drive is present on a spur gear element in driving connection with the toothed wheel gear.

5. Lockable glove compartment cover arrangement according to claim 1, further comprising a second spur gear element drivingly connected with said toothed wheel gear of the securing means.

6. Lockable glove compartment cover arrangement according to claim 5, wherein the securing means comprises a servomotor linked to the second spur gear element.

7. Lockable glove compartment cover arrangement according to claim 5, wherein a second push button is operatively connected to said second spur gear element to axially move said second spur gear element.

8. Lockable glove compartment cover arrangement according to claim 1 further comprising:

a second compartment cover for covering a second storage compartment in the vehicle dashboard or the like, second latch means for latching the second cover in a closed position, and second actuating element means for actuating the second latch means to an open position, wherein said second actuating element means include a second spur gear element operatively connected to a second push button to move axially therewith, said second spur gear element including an eccentrically offset abutment stud which is operable in response to movement of the second push button to effect actuation of the second latch means to an open position when in an unsecured rotation position and which is inoperable to effect actuation of the second latch means to an open position when in a secured rotative position, and wherein said toothed wheel gear is in meshing driving engagement with said second spur gear element to move the second spur gear element between its respective secured and unsecured position in response to rotation of the toothed wheel gear.

9. Lockable glove compartment cover arrangement according to claim 1, wherein the toothed wheel gear is rotatably fixed to a key actuable locking cylinder9

10. Lockable glove compartment cover arrangement according to claim 8, wherein the toothed wheel gear is rotatably fixed to a key actuable locking cylinder.

11. Lockable glove compartment cover arrangement according to claim 10, wherein a subassembly comprising the first and second push buttons and the locking cylinder is fitted permanently into an instrument panel of the vehicle.

12. Lockable glove compartment cover arrangement according to claim 1, wherein the first actuating element means comprises a first tripping lever abuttingly engageable by the first abutment stud and a first Bowden cable connection between the first tripping lever and the first latch means.

13. Lockable glove compartment cover arrangement according to claim 8, wherein the second actuating element means comprises a second tripping lever abuttingly engageable by the second abutment stud and a second Bowden cable connection between the second tripping lever and the second latch means.

14. Lockable glove compartment cover arrangement according to claim 8, wherein the first and second spur gear elements are circular segment shaped.

15. Lockable glove compartment cover arrangement according to claim 2, further comprising spring loaded locking means for locking the locking cylinder in respective end positions.

16. Lockable glove compartment cover arrangement according to claim 6, wherein the securing means comprises a locking cylinder with a cylinder core rotatably fixed with the toothed wheel gear and wherein a freewheel lost motion connection is provided between the rotary drive of the locking cylinder and the drive of the servomotor.

17. Lockable glove compartment cover arrangement according to claim 16, further comprising:

a second compartment cover for covering a second storage compartment in the vehicle dashboard or the like, second latch means for latching the second cover in a closed position, and second actuating element means for actuating the second latch means to an open position, wherein said second actuating element means include a second spur gear element operatively connected to a second push button to move axially therewith, said second spur gear element including an eccentrically offset abutment stud which is operable in response to movement of the second push button to effect actuation of the second latch means to an open position when in an unsecured rotation position and which is inoperable to effect actuation of the second latch means to an open position when in a secured rotative position, and wherein said toothed wheel gear is in meshing driving engagement with said second spur gear element to move the second spur gear element between its respective secured and unsecured position in response to rotation of the toothed wheel gear.

18. Lockable glove compartment cover arrangement according to claim 17, wherein the cylinder core of the locking cylinder is restorable out of each rotary position by the action of a return spring into a key withdrawal position, and wherein the toothed wheel gear on the locking cylinder side is anchored by engaging means in the limit positions of the freewheel connection.

19. Lockable glove compartment cover arrangement according to claim 18, wherein the servomotor is additionally controllable through a central locking installation of a vehicle.

20. Lockable glove compartment cover arrangement according to claim 19, wherein a raised switch cam which is arranged on an end face of the toothed wheel gear on the locking cylinder side, is sensed by a switch contact of a microswitch in order to inquire re the security state of the push-buttons.

21. Lockable glove compartment cover arrangement according to claim 18, wherein a further mechanically interlocked key withdrawal position is provided for the secured position of the locking cylinder.

22. Lockable glove compartment cover arrangement according to claim 8, wherein of the first and second covers are automatically transferable into an open position after a tripping of the associated latch means.

* * * * *